US006231409B1

(12) United States Patent
Kato

(10) Patent No.: US 6,231,409 B1
(45) Date of Patent: May 15, 2001

(54) MIXED-FLOW TYPE WATER JET PUMP OF WATERCRAFT AND ATTACHING STRUCTURE THEREOF

(76) Inventor: Hironori Kato, 295,Taniyagi, Okubo-cho, Akashi-shi, Hyogo 674-0062 (JP)

( * ) Notice: Subject to any disclaimer, the term of this patent is extended or adjusted under 35 U.S.C. 154(b) by 0 days.

(21) Appl. No.: 09/417,640

(22) Filed: Oct. 14, 1999

(30) Foreign Application Priority Data

Oct. 15, 1998 (JP) ..... 10-293856

(51) Int. Cl.[7] ..... B63H 11/00
(52) U.S. Cl. ..... 440/38
(58) Field of Search ..... 440/38, 83, 76, 440/111, 112

(56) References Cited

U.S. PATENT DOCUMENTS 4,541,808 * 9/1985 Ono et al. ..... 440/42
4,767,225 * 8/1988 Iio ..... 384/616
5,310,368 * 5/1994 Kamitake ..... 440/38

FOREIGN PATENT DOCUMENTS 06030599 7/1985 (JP) .

* cited by examiner

*Primary Examiner*—Stephen Avila

(57) ABSTRACT

A mixed-flow type water jet pump having configured so that a tip clearance between an inner wall of a pump casing and an outer peripheral edge of an impeller can easily be adjusted, and which can easily be mounted on a watercraft. A pump casing is divided into two portions, a front casing and a rear casing, in a longitudinal direction, the front casing for housing an impeller provided with a longitudinal position defined simply with respect to the rear casing and being attached to the rear casing through a shim such that a predetermined clearance is formed between an inner wall of the front casing and an outer peripheral edge of the impeller.

9 Claims, 8 Drawing Sheets

MIXED-FLOW TYPE WATER JET PUMP OF WATERCRAFT AND ATTACHING STRUCTURE THEREOF

BACKGROUND OF THE INVENTION

1. Field of the Invention

The invention relates to a mixed-flow type water jet pump to be used as a propulsion unit of a watercraft.

2. Description of the Related Art

A watercraft which is propelled by a water jet pump, for example, a personal watercraft (which is also referred to as a "PWC") is configured so as to suck water (including sea water) through a water intake port provided on a bottom of a hull of the watercraft, to pressurize and to accelerate the water by the water jet pump and to eject the water rearward from the hull through an outlet port of the water jet pump, thereby advancing the watercraft.

The water jet pump is configured so that an impeller is rotatably provided in a casing of which inner periphery is a circular cylinder-shaped.

Water jet pumps are broadly divided into so-called "mixed-flow type" water jet pumps and a so-called "axial-flow type" water jet pumps. In a "mixed-flow type" water jet pump, the outside diameter (outer edge) of a blade of an impeller thereof, and the outer diameter of a base portion thereof having a circular section to which the blade is attached, and the inner diameter of a inner wall of a pump casing thereof for covering the impeller, are gradually increased from the intake side toward the pressurization side. In an "axial-flow type" water jet pump, the outside diameter (outer edge) of an impeller, the outer diameter of a base portion having a circular section to which the blade is attached, and the inner diameter of a inner wall of a pump casing for covering the impeller, are straight (constant) from the intake side to the pressurization side.

In the water jet pump, pump performance is affected very greatly by the size of a tip clearance between the inner wall of the pump casing and the outer edge of the blade of the impeller. More specifically, the pump performance is degraded if the tip clearance is too great, and there is a possibility that a tip (an outer peripheral end) of the blade might temporarily come in contact with an inner wall of the pump casing if the clearance is too small. For this reason, generally, the tip clearance between the inner wall of the pump casing and the outer edge of the blade of the impeller is set to about 0.20 mm to about 0.30 mm.

In a mixed-flow type water jet pump, if the axial position of an impeller in a casing of the water jet pump is changed in a longitudinal (axial) direction, the tip clearance between the inner wall of the pump casing and the outer edge of the blade of the impeller is varied.

When assembly is performed, adjustment of the axial position of the impeller with respect to the pump casing is performed in the following way, such that the tip clearance between the inner wall of the casing and the outer edge of the blade of the impeller can be kept within the above-mentioned predetermined value.

As shown in FIG. 8, the pump casing 1C of the mixed-flow type water jet pump P is divided into two portions, that is, a "front casing 1Cf" and a "rear casing 1Cr" in a portion in which the pump casing 1C has the greatest diameter. A pump shaft 1S is rotatably provided in the rear casing 1Cr through a bearing 1H such that a front end thereof is protruded forward. An impeller 1Z to be rotated integrally with the pump shaft 1S is attached on the front end of the pump shaft 1S.

The impeller 1Z is installed as follows. A suitable number of sheet-shaped shims 35 for adjusting the clearance are provided between the bearing support side of the pump shaft 1S and the impeller 1Z, such that a clearance between the inner wall of the pump casing 1C (front casing 1Cf) which is a slanted face and the outer peripheral edge of the impeller 1Z is set within a predetermined range. Then, a female screw hole on the rear end of the impeller 1Z is screwed and fixed to a male screw on the front end of the pump shaft 1S.

When the impeller 1Z is completely arranged as described above, the front casing 1Cf is attached to the rear casing 1Cr having the pump shaft 1S and the impeller 1Z provided therein, and both of them are fixed to each other with attaching bolts (not shown).

When the assembly of the water jet pump is thus completed, a clearance gauge is inserted from the outside (the outside of the pump intake side) into the tip clearance between the inner wall of the front casing 1Cf and the outer peripheral edge of the impeller 1Z, thereby ascertaining whether the tip clearance is within a predetermined range. After an inspection of the clearance, the water jet pump is mounted on a personal watercraft, at the same time inserting and fixing a spline shaft of a propeller shaft (not shown) coupled to the engine at an opposite side, into a spline hole 1*b* formed on the front end of the impeller.

However, if the clearance is not obtained within the predetermined range during the inspection performed by using the clearance gauge, the front casing 1Cf is removed from the rear casing 1Cr by loosening the attaching bolts. The impeller is, further, removed from the pump shaft. The number of the shims is increased or decreased, and the water jet pump is assembled again, followed by checking and confirming the clearance again.

Typically, assembly and disassembly of the water jet pump is performed many times to adjust the clearance. Moreover, a curved clearance is measured by means of the clearance gauge plate. Therefore, the clearance cannot be accurately measured due to a rigidity of a plate (tongue) shaped "clearance gauge" which is generally used. Consequently, the assembly and disassembly could be performed many more times.

U.S. Pat. No. 4,541,808 (Japanese Patent Publication No. Sho 60-30599) describe a mixed-flow type water jet pump according to the prior art, and Japanese Patent Publication No. Hei 3-11955 and Japanese Laid-open Patent Publication No. Hei 9-207885 describe an axial-flow type water jet pump according to the prior art.

SUMMARY OF THE INVENTION

In consideration of such circumstances, it is a first objective of the present invention to provide a mixed-flow type water jet pump having such a structure adapted to easily adjust a clearance between an inner wall of a pump casing and an outer peripheral edge of an impeller.

It is a second objective of the invention to provide an attaching structure of the mixed-flow type water jet pump which can easily be mounted on a watercraft.

A first aspect of the invention is directed to a mixed-flow type water jet pump to be used as a propulsion unit of a watercraft, wherein a pump casing is divided into a front casing and a rear casing in a longitudinal direction. The front casing houses an impeller provided at a predetermined position in a longitudinal direction with respect to the rear casing and is attached to the rear casing through an intermediary of an adjusting shim such that a predetermined tip clearance is formed between an inner wall of the front casing and an outer peripheral edge of the impeller.

According to the mixed-flow type water jet pump having the above-mentioned structure, the impeller is provided in a predetermined relative position with respect to the rear casing during assembly. Then the front casing is joined with the rear casing up to a position where the outer peripheral edge of the impeller abuts against the inner wall of the front casing. In this state, a clearance between the rear casing and the front casing in the longitudinal direction is measured. According to the measured value, a shim having a predetermined thickness (the thickness exceeding the measured value, wherein a tip clearance between the inner wall of the casing and the outer edge of the blade of the impeller formed by the shim is previously confirmed) is provided between the rear casing and the front casing. Thus, the predetermined tip clearance can easily be formed. The above-mentioned "shim having a predetermined thickness" may be obtained by a plural number of shims or a shim having various thicknesses. Shims having various thicknesses may be previously prepared, and a shim having a desired thickness selected to obtain a shim having the predetermined thickness. The "predetermined thickness" means a thickness obtained by adding, to the measured value, a longitudinal dimension corresponding (correlating) to the dimension of the clearance to be formed between the outer peripheral edge of the impeller and the inner wall of the front casing.

In this structure, it is not necessary to remove the impeller each time for adjustment regarding the tip clearance, which differs from the prior art. In addition, the clearance between the rear casing and the front casing is parallel with a direction of the thickness of the thickness gauge. Therefore, the clearance can be measured very easily and accurately by means of the thickness gauge. Consequently, it is possible to efficiently perform assembly obtaining the predetermined tip clearance.

It is preferable that the rear casing mount a pump shaft rotatably in a longitudinal direction, and that the impeller is attached to the pump shaft to be rotated integrally.

Accordingly, a structure is provided which can be easily adjusted to obtain the predetermined tip clearance by inserting the shim between the front casing and rear casing.

It is preferable that the shim is made of stainless steel.

A second aspect of the invention is directed to an attaching structure of a mixed-flow type water jet pump which is to be used as a propulsion unit of a watercraft, and which needs positional setting in a longitudinal direction with respect to a fixing member in mounting to the watercraft. A front portion of a pump casing is formed like a taper, in which a diameter is reduced gradually toward the front end, and a groove is formed on the periphery of said front portion. A seal member is provided, having an outer peripheral face, and an inner peripheral face formed corresponding to the tapered front portion of said pump casing, and having a convex portion formed around the outer peripheral face, and a lip protruded inwardly around the inner peripheral face on a rear end portion, which attach to tapered front portion of said pump casing such that the lip of the seal member enters the groove. A tapered concave portion for attaching to the tapered front end portion of the pump casing with the seal member is formed on a fixing member fixed to a body of the watercraft; such that the convex portion of the seal member is depressed at least, and the lip is depressed in the groove in a fixing state, so that the water jet pump is attached to the fixing member in a sealing state.

According to the attaching structure of the water jet pump having such a structure, even if the position of the front end of the waterjet pump is slightly shifted in the longitudinal direction with respect to the fixing member, and the water jet pump is provided in a reference position, the seal member is deformed to produce a seal function. Accordingly, it is possible to obtain a preferable attachment of the structure of the mixed-flow type water jet pump in accordance with the first aspect of the invention, for example, in which a position where the water jet pump is to be attached is changed or the whole length is varied.

Furthermore, it is preferable that the seal member has a second lip protruded inwardly around an inner peripheral face on a front end portion such that the second lip locates on a front face of the front casing in attaching state.

With this structure, it is easy to attach the water jet pump to the fixing member.

Moreover, if the seal member has a convex portion at an interval in two places, it is possible to obtain a structure giving higher seal performance.

These objects as well as other objects, features and advantages of the invention will become more apparent to those skilled in the art from the following description with reference to the accompanying drawings.

DETAILED DESCRIPTION OF THE PREFERRED EMBODIMENT(S)

A mixed-flow type water jet pump and an attaching structure thereof according to embodiments of the present invention will be described below with reference to the drawings using, as an example, the case where they are used in a personal watercraft.

Figure 1:
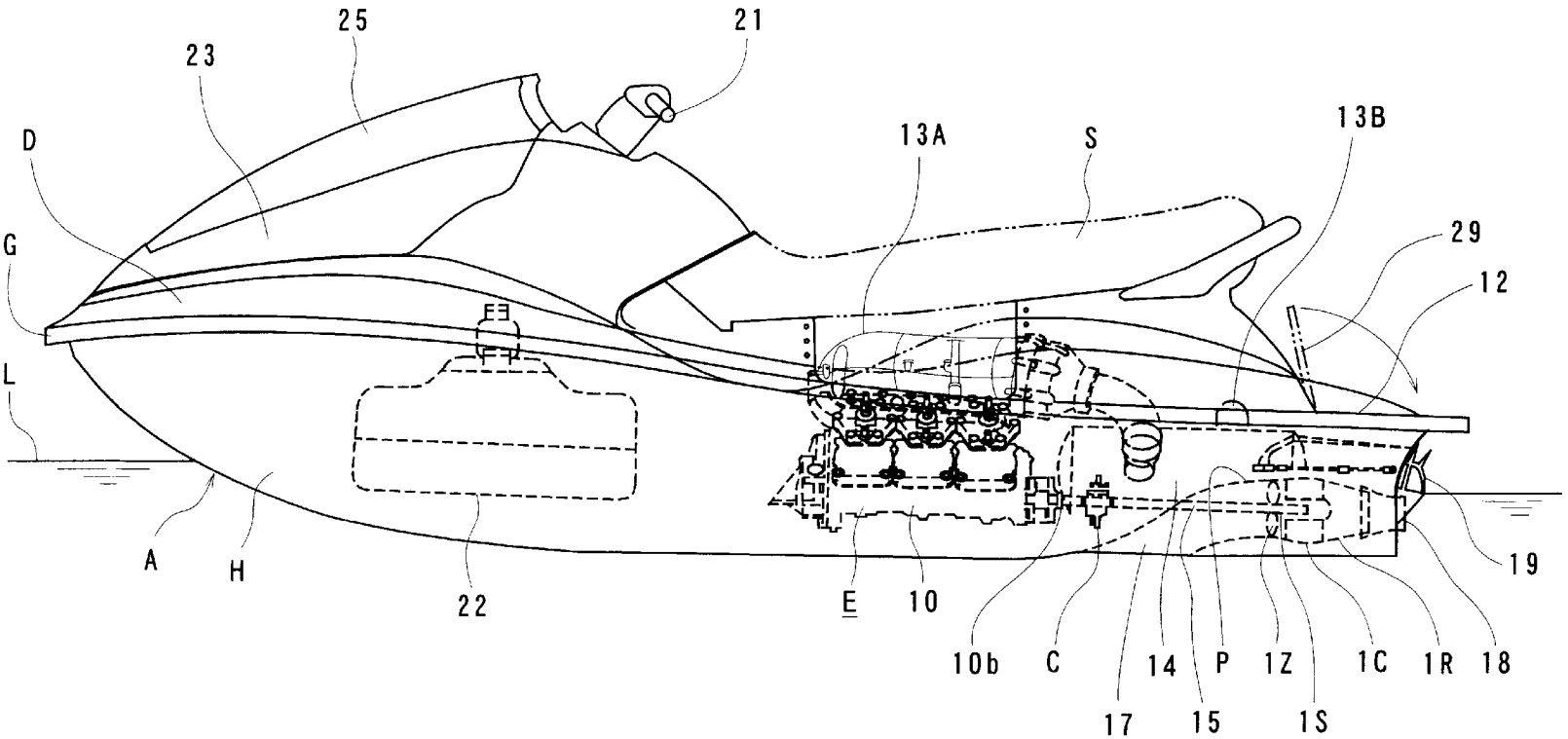
FIG. 1 is a side view showing a personal watercraft (with seat removed) mounting a mixed-flow type water jet pump and using an attaching structure thereof according to an embodiment of the invention.
Figure 2:
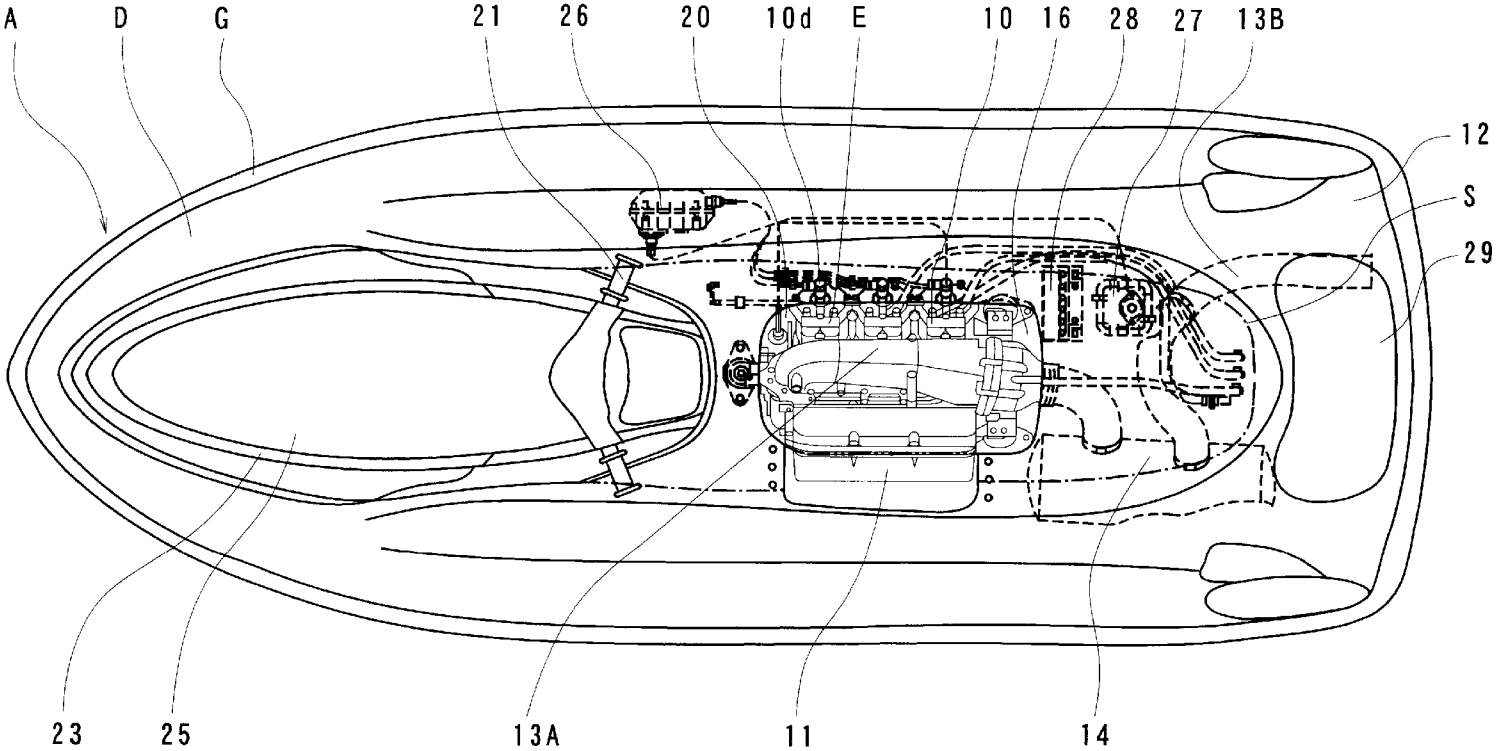
FIG. 2 is a plan view showing the personal watercraft illustrated in FIG. 1.

In FIGS. 1 and 2, A denotes a body of a personal watercraft. The body A comprises a hull H and a deck D covering an upper portion of the hull H. A line for connecting the hull H to the deck D over the entire periphery is referred to as a gunwale line G. In the present embodiment, the gunwale line G is positioned above a waterline L of the personal watercraft.

An opening 16 having a top face that is almost rectangular as seen in a plan view along the longitudinal direction of the body A is formed slightly behind the center of the deck D as shown in FIG. 2. As shown in FIGS. 1 and 2, a riding seat S is provided above the opening 16.

An engine E is provided in a space (referred to as an "engine space") 20 having a convex cross-sectional shape surrounded by the hull H and the deck D below the seat S.

Figure 3:
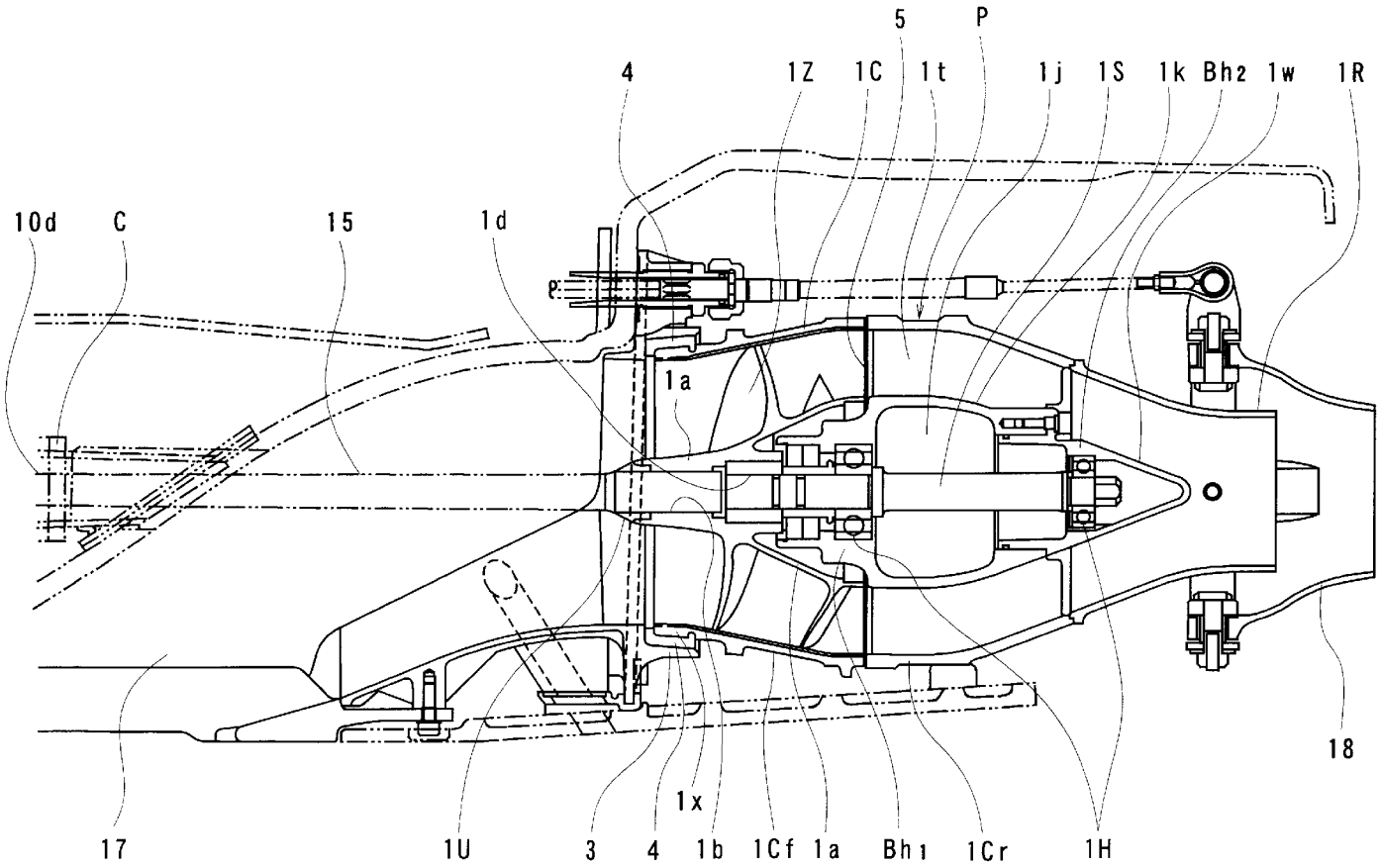
FIG. 3 is an enlarged view showing the detailed structure of the mixed-flow type water jet pump illustrated in FIG. 2.

The engine E is a multi-cylinder (three-cylinder in the embodiment) engine. As shown in FIG. 1, a crankshaft 10*b* of the engine E is mounted in the longitudinal direction of the body A. As shown in FIG. 2, a carburetor 11 and an air intake chamber (not shown) connected thereto are provided on the left side of an engine block 10 (the port side of the personal watercraft). As shown in FIGS. 1 and 2, an exhaust pipe 13A is provided above the engine block 10. The exhaust pipe 13A is connected to a silencer 14 provided at the oblique left side portion behind the engine block 10. An exhaust pipe 13B having a terminal reaching the outside of the rear end of the body A from the silencer 14 is bent above to keep away from a water jet pump P. As shown in FIGS. 1 and 3, an output end of the crankshaft 10*b* projecting from the rear portion of the engine block 10 is rotatably coupled integrally with a tip portion of an impeller 1Z of the water jet pump P through a propeller shaft 15. Furthermore, a rear portion of the impeller 1Z is rotatably coupled integrally with a pump shaft 1S of the waterjet pump P. The impeller 1Z is covered with a pump casing 1C on the outer periphery thereof. The water jet pump sucks water through a water intake passage, from a water intake port(water feeding port) 17 provided on the bottom of the personal watercraft, and to pressurize and accelerate the water. The pressurized and accelerated water is ejected from a outlet port provided on the rear end of an pump nozzle 1R having a cross-sectional area of flow gradually reduced rearward, thereby obtaining propulsive force. In FIGS. 1 and 2, the reference numeral 21 denotes a steering handle. By operating the handle 21 right and left side, a steering nozzle 18 provided behind the pump nozzle 1R is swung from side to side so that steering can be performed in a desired direction. A reverse deflector 19 (see FIG. 1) is provided above the rear side of the steering nozzle 18 such that it can be swung downward around a swinging shaft provided horizontally. By swinging down the bowl-shaped deflector 19 toward a lower position behind the steering nozzle 18, the water to be discharged rearward from the steering nozzle 18 is turned forward. Consequently, the personal watercraft can go astern.

In FIGS. 1 and 2, the reference numeral 12 denotes a rear deck. The rear deck 12 is provided with an openable hatch cover 29. A housing box having a small capacity is formed under the hatch cover 29. In FIG. 1, the reference numeral 22 denotes a fuel tank for supplying a fuel to the engine E, and the reference numeral 23 denotes a front hatch cover. A box (not shown) for housing fittings and the like is provided under the hatch cover 23. Another hatch cover 25 is provided over the front hatch cover 23, thereby forming a double hatch cover. A life jacket and the like can be housed under the hatch cover 25. In FIG. 1, reference mark C denotes a coupler for connecting the crankshaft 10*b* and propeller shaft 15.

In FIG. 2, the reference numeral 26 denotes an ignition device for supplying high voltage electricity to an ignition plug 10*d* in a proper timing, the reference numeral 27 denotes an oil tank for mixing, and the reference numeral 28 denotes a battery.

The water jet pump P enlarged in FIG. 3 according to an embodiment is a mixed-flow type water jet pump having the following structure. As is shown in FIG. 3, a pump casing 1C comprises a front casing 1Cf and a rear casing 1Cr which are divided in a portion having the greatest diameter of the casing 1C. In their junction(connecting) portion, a sheet shim(shims) 5 having a predetermined thickness is (are) provided as is further enlarged in FIG. 4. For example, four sheet shims 5 having a thickness of 0.5 mm per shim are provided in one embodiment. A positioning knock pin (not shown) protrudes from one of the casings in the junction portion, and a positioning hole (or a cut-out) corresponding to the knock pin (which is not shown) is provided in the shim 5 side such that the shim 5 can be positioned with respect to the front or rear casing. In order to cause the shim 5 to have anticorrosive performance, stainless steel can be used for the material of the shim 5.

Figure 4:
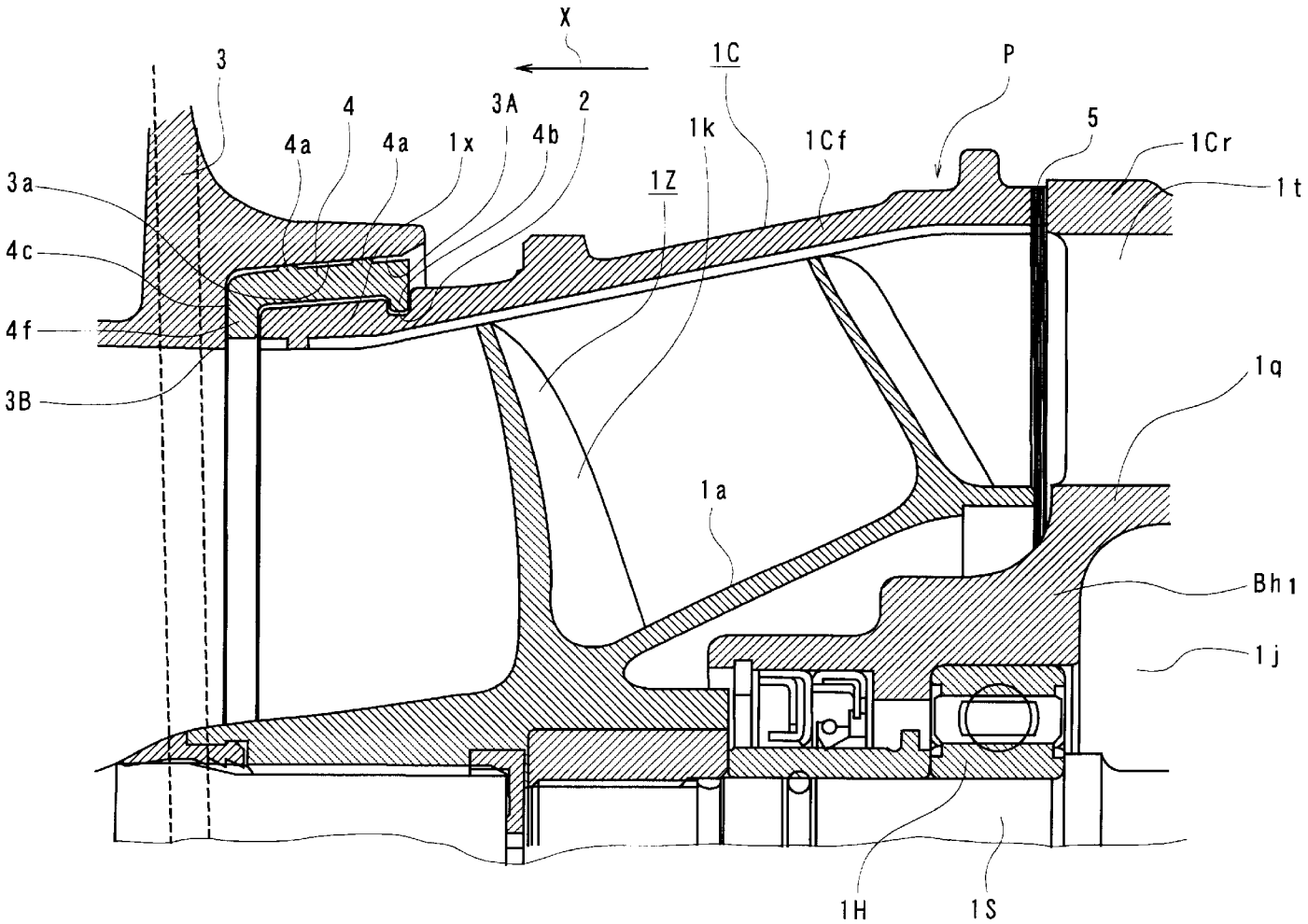
FIG. 4 is an enlarged view showing a main portion of the water jet pump illustrated in FIG. 3.

As shown in FIG. 3 and FIG. 4, the impeller 1Z of the water jet pump P has a base portion 1*a* having a circular section and has blades 1*k* fixed to the base portion 1*a* with a pitch angle. A spline hole 1*b* to be connected with the propeller shaft 15 is formed in a front portion of the base portion 1*a* and a screw hole 1*d* to be connected with the pump shaft 1S is formed in a rear portion of the base portion 1*a*. Respective outer diameters of the blades 1*k* and the base portion 1*a* of the impeller 1Z are gradually increased toward the rear end. An inner diameter of an inner peripheral face of the front casing 1Cf which covers the impeller 1Z, having a predetermined clearance therebetween, is gradually increased toward the rear end corresponding to the outer edge of the blades 1*k*.

A stationary base portion 1*q* having a front bearing housing $Bh_1$ is formed integrally with the rear casing 1Cr, and a space 1*j* is formed inside of the stationary base portion 1*q* and stationary blades (fairing blades) 1*t* is formed on the outside of the stationary base portion 1*q*. The stationary blades 1*t* with a pitch angle regulates a spired and faired flow of the water at the back of the impeller 1Z, and connects the stationary base portion 1*q* integrally with a cylindrical outer shell of the rear casing 1Cr. A fairing cone 1*w* is provided on the rear end of the stationary base portion 1*q* so as to cover a rear bearing housing $Bh_2$ formed on the inside.

The bearing housings $Bh_1$ and $Bh_2$ are provided with a ball bearing 1H, respectively. The pump shaft 1S is arranged in the longitudinal direction and rotatably mounted by the ball bearing 1H. The impeller 1Z is screwed to the front end of the pump shaft 1S (the side end of the front casing 1Cf) such that it can be rotated integrally with the pump shaft 1S. In the water jet pump according to the embodiment, a shim for adjusting an axial position between the impeller Z and the pump shaft 1S is not used when the impeller 1Z is to be attached. Accordingly, there is a possibility that the longitudinal position of the impeller Z might have a dimensional error due to the accumulation of manufacturing tolerance with respect to the rear casing 1Cr.

Therefore, in the mixed-flow type water jet pump P, the tip clearance between the inner wall of the pump casing 1C and the outer peripheral edge of the impeller 1Z is adjusted as follows.

As described above, the pump shaft 1S and the impeller 1Z are fixed to the rear casing 1Cr and are pre-assembled on an assembly table such that the impeller 1Z is positioned up side. Then, the front casing 1Cf is carefully put on the rear casing 1Cr from above up to a position where the outer peripheral edge of the impeller 1Z abuts against the inner wall of the front casing 1Cf. In the abutting state, a clearance between the rear casing 1Cr and the front casing 1Cf is measured by using a thickness gauge which is commercially available. Since a thickness gauge can insert straight, the measurement can be performed easily and accurately. For a measured value, a shim(shims) 5 having a predetermined thickness is(are) provided between the rear casing 1Cr and the front casing 1Cf, thereby forming a clearance ranging within a predetermined dimension between the inner wall of the front casing 1Cf and the outer peripheral edge of the impeller 1Z. More specifically, in one embodiment, when one shim 5 having a thickness of 0.5 mm is inserted between the front casing 1Cf and the rear casing 1Cr, the tip clearance of 0.1 mm is formed between the inner wall of the front casing 1Cf and the outer peripheral edge of the impeller 1Z whereby the inner wall of the front casing 1Cf previously obtained (stored) as design data (or execution data). If the measured value of the thickness gauge is 0.7 mm, for example, four shims 5 are provided between the rear casing 1Cr and the front casing 1Cf. Instead of thus using a plurality of shims 5 in combination, shims having various thicknesses may be previously prepared to select a shim having a corresponding thickness to be used.

As a result, a clearance of 0.26 mm is formed between the inner wall of the pump casing 1C and the outer peripheral edge of the impeller 1Z. Accordingly, when the measured value of the thickness gauge is 0.4 mm, the clearance between the inner wall of the pump casing 1C and the outer peripheral edge of the impeller 1Z becomes 0.22 mm if three shims 5 are provided between the rear casing 1Cr and the front casing 1Cf.

Thus, in the mixed-flow type water jet pump having the structure as described above, tip clearance can easily be adjusted in a relatively short time without the need for attaching and removing the impeller 1Z to and from the pump shaft 1S for each assembly and disassembly. This eliminates the trial and error and need for performing the assembly and disassembly many times.

Figure 7:
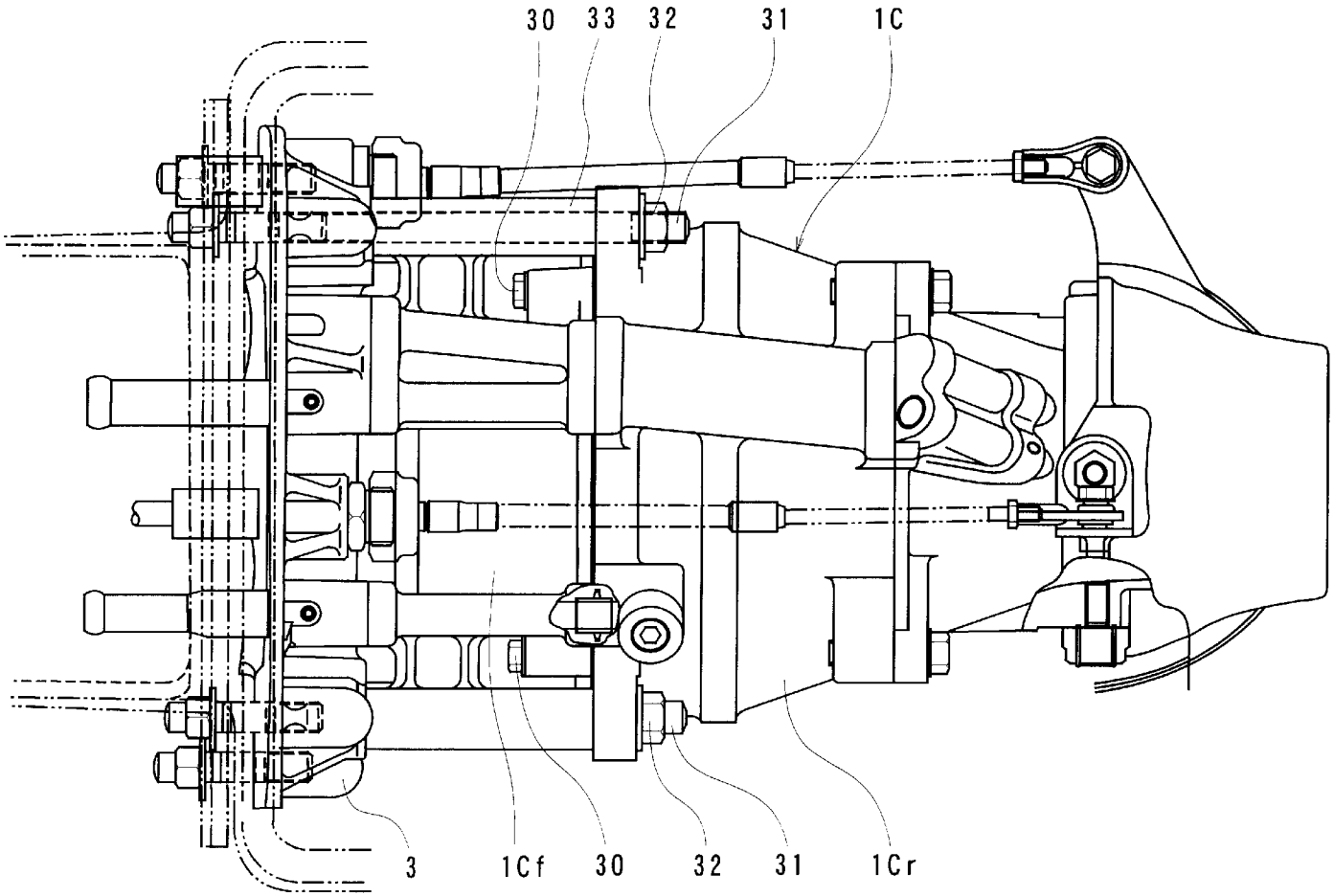
FIG. 7 is a plan view showing a state in which a pump casing is attached to a fixing member of the watercraft.
Figure 8:
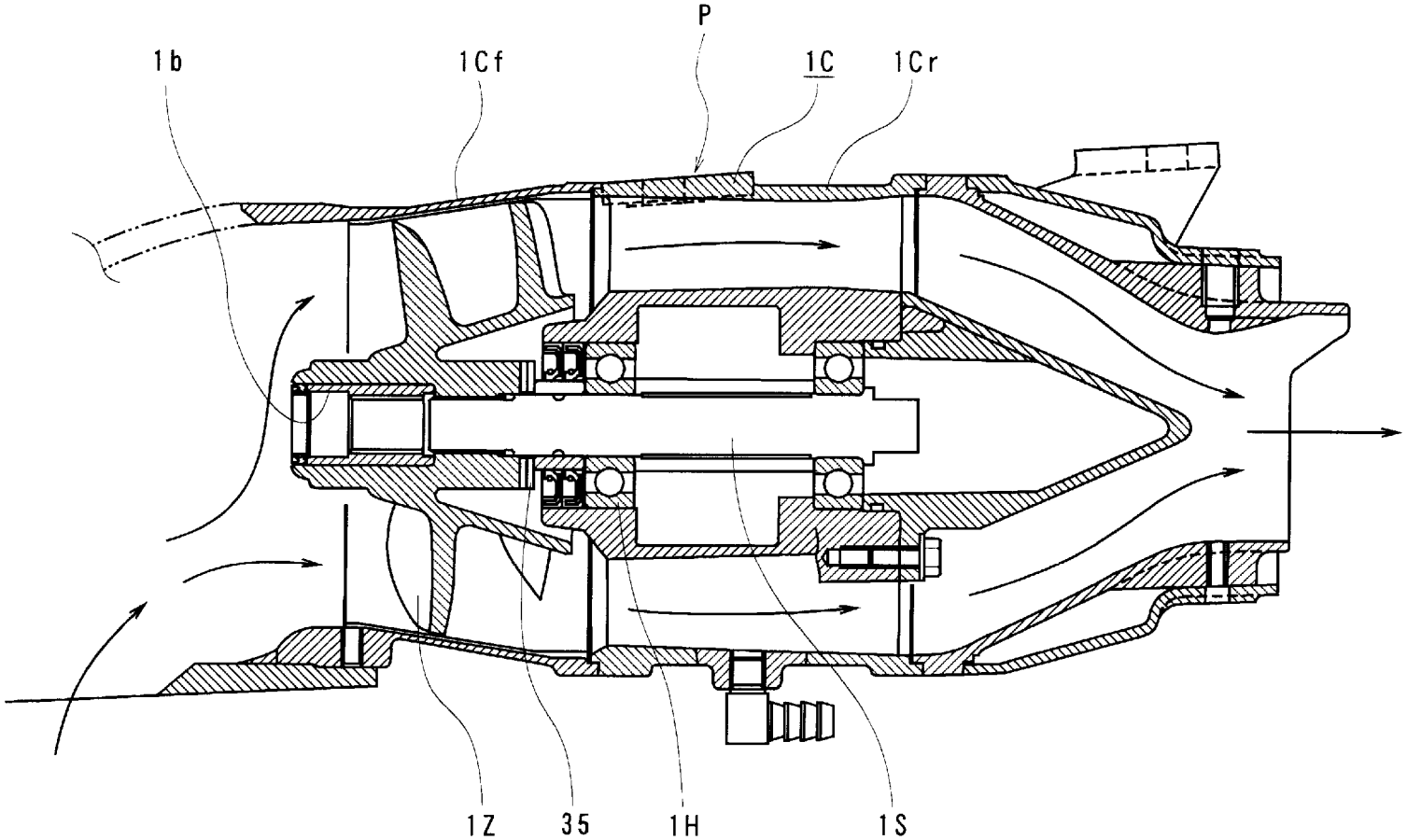
FIG. 8 is an enlarged sectional side view showing a structure of a mixed-flow type water jet pump according to the prior art.

When the adjustment of the tip clearance is thus completed, the front casing 1Cf is fixed to the rear casing 1Cr with fixing bolts 30 provided around the casing as shown in FIG. 7.

In the mixed-flow type water jet pump having the structure according to the present embodiment, the whole length of the water jet pump P is slightly changed by the thickness of the shim(s) 5.

Even if the whole length of the water jet pump P is thus changed, it is possible to easily fix a seal structure to a fixing member on the body of the watercraft by using the attaching structure according to a following embodiment.

As shown in FIG. 3 or FIG. 4, a front portion (a portion on the intake side) 1*x* of the water jet pump P is formed like a taper having a slightly small diameter on the front end side, and a groove 2 is provided on the periphery of the tapered front portion 1*x* of the front casing 1Cf. In this embodiment, the groove 2 is formed with a cross section having a rectangular shape as shown in FIG. 4.

The front portion 1*x* is provided with a seal member 4 as shown in FIG. 3 or FIG. 4. The seal member 4 is made of soft rubber, and has a configuration of a taper plate in which the whole shape corresponds to the shape of the front portion 1*x* of the pump casing 1C and has a front end wall 4*f* which is opened excluding a peripheral edge (see FIG. 3). A convex portion 4*a* (a semicircular section) is formed on the outer periphery of the seal member 4 in two portions apart from each other in a longitudinal direction such that it turns around the outer peripheral face of the seal member 4, and a lip 4*b* having an almost rectangular section is formed on the inner peripheral face of a rear end of the seal member 4. The lip 4*b* is protruded inwardly around the inner peripheral face of the seal member 4, has a smaller width than the width of the groove 2 and has as great a dimension in a direction of a height (depth) as the depth of the groove 2. A front end 4*c* of the seal member 4 has a second lip 4*f* protruded inwardly around the inner peripheral face, thereby forming the front end wall 4*f* of the seal member 4, and which has an opening 4*d* inside of the lip 4*f*.

A concave portion 3A corresponding to the tapered shape of the front portion 1*x* of the pump casing 1C is formed as a pump receiving seat on a fixing member 3, fixed to the body of the watercraft. The concave portion 3A takes a ring shape having an almost L-shaped cross section, and an inner peripheral face 3*a* of the concave portion 3A is formed by a tapered face having the same taper angle as the taper angle of the front portion 1*x* of the pump casing 1C. The fixing member 3 is also provided with an opening 3B having the same diameter as (or a slightly smaller diameter than) the diameter of the opening 4*d* of the seal member 4. The opening 3B functions as a water flow portion of the water jet pump P.

Figure 5:
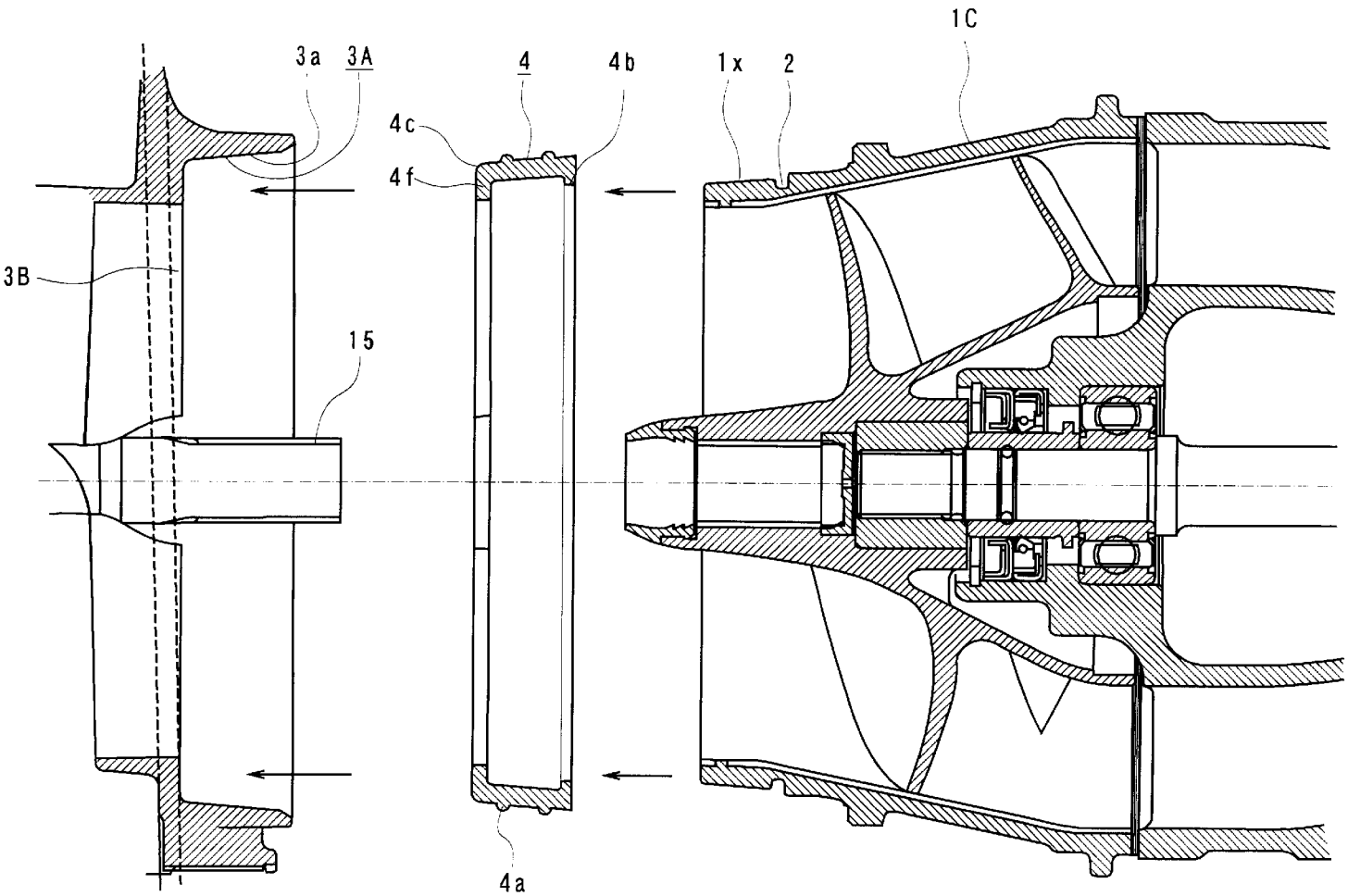
FIG. 5 is an exploded sectional side view of the water jet pump of FIG. 3 showing a state in a process of assembling.

According to the attaching structure having such a structure, the seal member 4 is attached to the front portion 1*x* of the pump casing 1C such that the bent front end wall 4*f* is fitted to the front face of the pump casing 1C and the lip 4*b* of the seal member 4 is fitted in the groove 2 of the front portion 1*x* as shown in FIG. 5.

Figure 6:
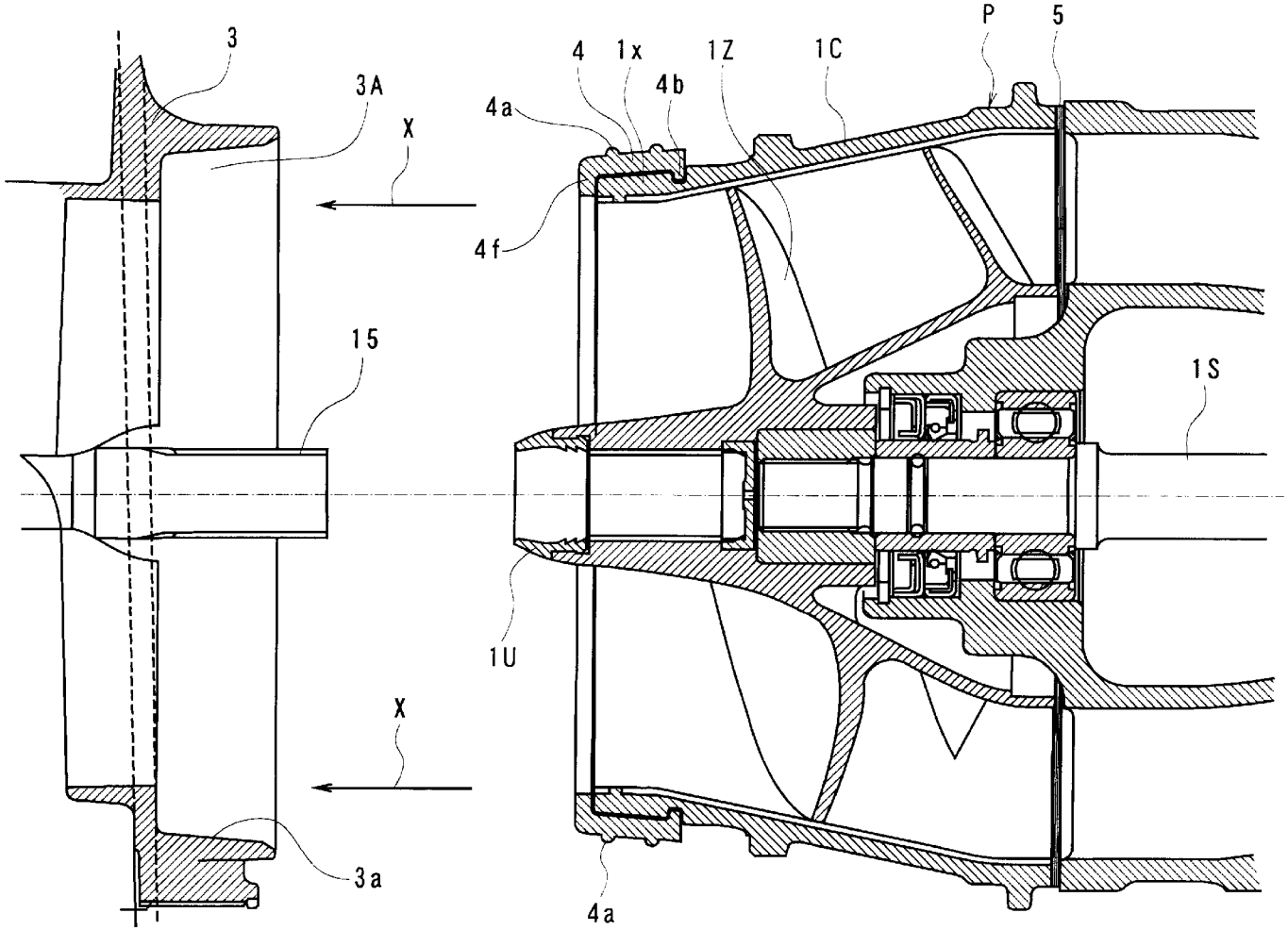
FIG. 6 is an exploded sectional side view of the water jet pump of FIG. 3 showing another state of a process of assembling.

Next, the front portion 1*x* of the pump casing 1C to which the seal member 4 is attached is inserted into the concave portion 3A of the fixing member 3 from the back side(see a direction shown by an arrow X) as shown in FIG. 6, and the rear casing 1Cr portion of the pump casing 1C is fixed to the fixing member 3 through spacers 33 with stud bolts 31 which are screwed to the fixing member 3 and a nut 32 as shown in FIG. 7. By the insertion and fixation as shown in FIG. 4, the lip 4*b* of the seal member 4 is depressed to block the groove 2 therein, and the convex portion 4*a* of the seal member 4 is depressed by the inner peripheral face 3*a* of the concave portion 3A so that a portion between the fixing member 3 and the pump casing 1C is sealed. Depending on the degree of the insertion, the front end wall 4*f* of the seal member 4 is depressed between the fixing member 3 and the pump casing 1C, and a portion therebetween is also sealed.

The seal member 4 is formed of soft rubber. Therefore, even if the degree of the insertion (the degree of the insertion in a longitudinal direction) between the fixing member 3 and the front casing 1Cf of the pump casing 1C (water jet pump P) is changed by about 2 to 3 mm, sealing properties can be held by the elasticity of the seal member 4 and the above-mentioned structure. More specifically, even if the whole length of the water jet pump P is changed by about 1 to 2 mm according to the number of the shims 5 to be provided, the water jet pump P can be attached to the fixing member 3 with the sealing properties held.

While the mixed-flow type water jet pump of a personal watercraft has been described with respect to the above-mentioned embodiment of the invention, it is apparent that the invention can also be applied to a mixed-flow type water jet pump of a watercraft having a greater size.

Although the structure in which the pump shaft is provided on the rear casing side has been described in the above-mentioned embodiment, it is apparent that the invention can similarly be carried out even if the pump shaft is provided on another casing.

Furthermore, it is apparent that the embodiment can also be applied to an axial-flow type water jet pump other than the mixed-flow type water jet pump.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

I claim:

1. A mixed-flow type water jet pump having a longitudinal axis, and an impeller, to be used as a propulsion unit of a watercraft, comprising:

a pump casing, further comprising:

a front casing disposed upstream along the longitudinal axis, and configured for housing the impeller; and a rear casing, disposed downstream of the front casing along the longitudinal axis wherein said rear casing mounts a pump shaft rotatable at a predetermined position in a longitudinal direction, and said impeller is attached to said pump shaft to be rotated integrally; and an adjustment shim, said front casing being attached to said rear casing through the intermediary of the adjustment shim, such that a predetermined tip clearance between the impeller and the front casing is formed between an inner wall of the front casing and an outer peripheral edge of the impeller.

2. A mixed-flow type water jet pump in accordance with claim 1, wherein a thickness of said shim is determined based on a measured value of a clearance between the rear casing and the front casing when an outer peripheral edge of the impeller abuts against an inner wall of the front casing.

3. A mixed-flow type water jet pump in accordance with claim 1, wherein said shim is made of stainless steel.

4. An attaching structure of a mixed-flow water jet pump configured for use as a propulsion unit of a watercraft and which needs positional setting in a longitudinal direction with respect to a fixing member affixed to the watercraft, comprising;

a pump casing, wherein a front portion of the pump casing is formed like a taper in which a diameter is reduced gradually toward the front end and a groove is formed on the periphery of said front portion, a seal member having an outer peripheral face and an inner peripheral face formed corresponding to the tapered front portion of said pump casing, and having a convex portion formed around the outer peripheral face and a lip protruding inwardly around the inner peripheral face on a rear end portion, which attaches to the tapered front portion of said pump casing, such that the lip of the seal member enters the groove, a tapered concave portion formed in the fixing member, configured for receiving the tapered front end portion of the pump casing with the seal member disposed thereon, whereby the fixing member affixed to a body of the watercraft receives the tapered front portion of the pump casing such that the convex portion of the seal member is depressed and the lip is disposed in the groove in a fixing state, so that the water jet pump is attached to the fixing member in a sealing state.

5. An attaching structure of a mixed-flow type water jet pump in accordance with claim 4, wherein said seal member further comprises a second lip protruded inwardly around an inner peripheral face on a front end portion of the seal member such that said second lip is located on a front face of the front casing when in an attached state.

6. An attaching structure of a mixed-flow type water jet pump in accordance with claim 4, wherein the convex portion of the sealing member is formed at an interval in two places.

7. A mixed-flow type water jet pump having a longitudinal axis, and an impeller, to be used as a propulsion unit of a watercraft, comprising:

a pump casing, further comprising:

a front casing disposed upstream along the longitudinal axis, and configured for housing the impeller; and a rear casing, disposed downstream of the front casing along the longitudinal axis, wherein said rear casing mounts a pump shaft rotatable in a longitudinal direction, and said impeller is attached to said pump shaft to be rotated integrally and an adjustment shim;

said impeller being provided at predetermined position in a longitudinal direction with respect to said rear casing, and said front casing being attached to said rear casing through an intermediary of the adjusting shim, such that a predetermined tip clearance between the impeller and the front casing is formed between an inner wall of the front casing and an outer peripheral edge of the impeller, further comprising:

an attaching structure comprising:

a tapered front portion of the pump casing, formed such that a diameter is reduced gradually toward the front end and a groove is formed on the periphery of said front portion, a seal member which attaches to the tapered front portion of said pump casing, having an outer peripheral face and an inner peripheral face formed corresponding to the tapered front portion of said pump casing, and having a convex portion formed around the outer peripheral face and a lip protruding inwardly around the inner peripheral face on a rear end portion such that the lip of the seal member enters the groove, a fixing member incorporating a tapered concave portion, fixed to a body of the watercraft, configured for attaching to the tapered front end portion of the pump casing with the seal member, such that the convex portion of the seal member is depressed and the lip is received in the groove in a fixing state so that the water jet pump is attached to the fixing member in a sealing state.

8. A mixed-flow type water jet pump in accordance with claim 7, wherein said seal member further comprises a second lip protruded inwardly around an inner peripheral face on a front end portion of the seal member such that said second lip is located on a front face of the front casing when in an attached state.

9. A mixed-flow type water jet pump in accordance with claim 7, further comprising a second convex portion, whereby a convex portion of the sealing member is formed at an interval in two places.

* * * * *

UNITED STATES PATENT AND TRADEMARK OFFICE

CERTIFICATE OF CORRECTION

PATENT NO. : 6,231,409 B1
DATED : May 15, 2001
INVENTOR(S) : Hironori Kato

It is certified that error appears in the above-identified patent and that said Letters Patent is hereby corrected as shown below:

Title page,
Below item [76], insert the following:
-- [73] Assignee: Kawasaki Jukogyo Kabushiki Kaisha
Kobe-shi, Hyogo 650-8670, Japan --

Signed and Sealed this

Eighth Day of October, 2002

*Attest:*

*Attesting Officer*

JAMES E. ROGAN
*Director of the United States Patent and Trademark Office*